US011629841B1

(12) United States Patent
Massoni

(10) Patent No.: US 11,629,841 B1
(45) Date of Patent: Apr. 18, 2023

(54) LAMP WITH CHANGEABLE DECORATIVE OR INFORMATION INSERT

(71) Applicant: Paula Massoni, Portola Valley, CA (US)

(72) Inventor: Paula Massoni, Portola Valley, CA (US)

( * ) Notice: Subject to any disclaimer, the term of this patent is extended or adjusted under 35 U.S.C. 154(b) by 0 days.

(21) Appl. No.: 17/902,880

(22) Filed: Sep. 4, 2022

Related U.S. Application Data

(63) Continuation-in-part of application No. 17/516,918, filed on Nov. 2, 2021, now Pat. No. 11,468,802.

(51) Int. Cl.

| | |
|---|---|
| ***F21V 1/04*** | (2006.01) |
| ***F21S 6/00*** | (2006.01) |
| ***G09F 13/04*** | (2006.01) |
| ***G09F 23/06*** | (2006.01) |
| *F21V 23/04* | (2006.01) |
| *F21V 23/00* | (2015.01) |

(52) U.S. Cl.
CPC ..... *F21V 1/04* (2013.01); *F21S 6/002* (2013.01); *G09F 13/0458* (2021.05); *G09F 13/0481* (2021.05); *G09F 23/06* (2013.01); *F21V 23/001* (2013.01); *F21V 23/04* (2013.01)

(58) Field of Classification Search
CPC ..... F21W 2121/00; F21W 2121/002; F21W 2121/004; F21W 2121/006; F21W 2121/008; F21W 2121/02; F21W 2121/04; F21W 2121/06; F21S 6/00; F21S 6/001; F21S 6/002; F21S 6/003; F21S 6/004; F21S 6/005; F21S 6/006; F21S 6/007; F21S 6/008; F21V 1/00; F21V 1/02; F21V 1/04; F21V 1/06; F21V 1/08; F21V 1/10; F21V 1/12
See application file for complete search history.

(56) References Cited

U.S. PATENT DOCUMENTS

| | | | | |
|---|---|---|---|---|
| 3,964,194 | A | 6/1976 | Gugeler | |
| 5,598,652 | A | 2/1997 | Nurre | |
| 6,550,936 | B2 * | 4/2003 | Foley | F21V 5/02 362/171 |
| 7,422,355 | B2 * | 9/2008 | Hirata | F21V 1/00 362/161 |
| 8,911,101 | B2 | 12/2014 | Tsai | |
| 9,121,557 | B2 | 9/2015 | Yang | |
| 9,206,952 | B2 | 12/2015 | Gold et al. | |
| 10,139,058 | B2 * | 11/2018 | Santiago | G09F 13/0413 |
| 2009/0323315 | A1 * | 12/2009 | Tuite | G09F 13/04 362/98 |

* cited by examiner

*Primary Examiner* — Robert J May
(74) *Attorney, Agent, or Firm* — Dana Legal Services; Jubin Dana

(57) ABSTRACT

A system and method are disclosed for a lamp that includes a unit having a slit. The slit receives various inserts that allow the lamp to adapt in appearance for changing the décor of a room and/or provide information to a user in proximity to the lamp.

20 Claims, 11 Drawing Sheets

LAMP WITH CHANGEABLE DECORATIVE OR INFORMATION INSERT

CROSS REFERENCE TO RELATED APPLICATION

This application is a continuation-in-part of U.S. application Ser. No. 17/516,918 filed on Nov. 2, 2021 titled SYSTEM AND METHOD FOR LAMP WITH CHANGEABLE DECORATIVE OR INFORMATION DISPLAY CAPABILITY the entire disclosure of which is incorporated herein by reference.

FIELD OF THE TECHNOLOGY

The invention is in the field of electrical devices and, more specifically, for a lamp with changeable display region.

BACKGROUND

LED or incandescent light bulbs are used in lamps, which are electrical devices. The lamps typically have a base, a body, an electrical receiving portion where the light bulb is secured, and sometimes a shade portion. Some of these lamps are used on a desk or a working surface. The lamps on the desk or working surface are used to provide lighting and the aesthetic feature of lamp typically is not changeable. Given that these lamps are located on a surface in close proximity to a person, there is a need to be able to change the appearance of the lamp or to use the lamp to provide information to a user. Therefore, what is needed is a system and method for a lamp that can be adapted in appearance and/or provide information to a user in proximity to the lamp.

SUMMARY

In accordance with various aspects and embodiments of the invention, a system and method for a lamp that can be adapted in appearance and/or provide information to a user in proximity to the lamp. The overall system allows updating the appearance of the lamp and/or using the lamp to communicate information to a user. There are numerous advantages provided by the system and method of the invention, including the ability to adapt the lamp to the décor of the room. Further, the lamp can be adapted to provide information, including local news, menus, etc.

BRIEF DESCRIPTION OF THE DRAWINGS

The invention is described in accordance with the aspects and embodiments in the following description with reference to the figures (FIGs.), in which like numbers represent the same or similar elements.

DETAILED DESCRIPTION

Reference throughout this specification to "one embodiment," "an example," "one example," "an embodiment," or similar language, means that a particular feature, structure, or characteristic described in connection with the various aspects of the invention may be included in at least one embodiment of the invention. Thus, appearances of the phrases "in one embodiment," "in an embodiment," "in one example," "in certain embodiments," and similar language throughout this specification refer to the various examples of the invention and are used interchangeably. It is noted that, as used in this description, the singular forms "a," "an" and "the" include plural referents, unless the context clearly dictates otherwise.

The described features, structures, or characteristics of the invention may be combined in any suitable manner in accordance with the aspects and one or more embodiments of the invention. In the following description, numerous specific details are recited to provide an understanding of various embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring the aspects of the invention.

Figure 1:
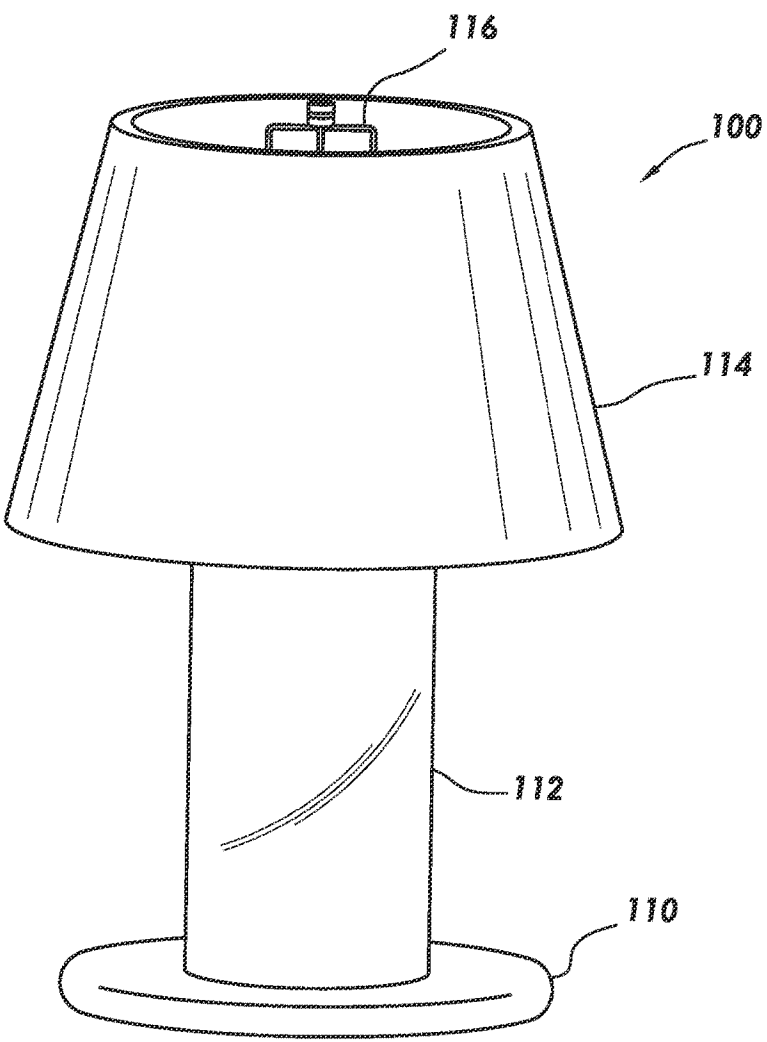
FIG. 1 shows a lamp with a receiving unit and a base in accordance with the various aspects and embodiments of the invention.

Referring now to FIG. 1 a lamp 100 is shown in accordance with one embodiment of the invention. The lamp 100 includes a base 110, a unit 112, a shade 114 and a shade support 116. In one embodiment, the unit 112 includes various parts, as outlined below, to allow it to receive an insert, such as various printed material, color design prints or printed words. The printed words may be information (such as a menu or a newspaper) or advertisement. In one embodiment, the unit 112 includes various parts, as outlined below, to allow it to receive a flexible display as an insert. The flexibly display can show various images or printed words. In accordance with some embodiments, the flexible display can be remotely programmed and can communicate wirelessly with a personal device (or computer) to receive the information or images that are to be displayed. The lamp 100 also includes a socket (not shown in FIG. 1) for receiving a light bulb (not shown). In accordance with some embodiments, the socket is secured to the base 110 and used to provide power to a light bulb inserted therein and generate lighting.

The lamp 100 also includes wiring (not shown) connected to the socket. The wiring is connected to a power source. In accordance with some embodiments, the power source may be AC, such as a 110V or 220V outlet. In accordance with some embodiments, the power source may be DC, such as a battery. In accordance with some embodiments, the power source may be solar cells or photovoltaic to convert illumination (such as Sun's rays or lighting) to power. In accordance with some embodiments, the power source is a combination of AC and DC used with or without solar cells. Further, the power source may use a combination of solar cells to power the lamp and store the energy in a battery (for later power supply to the lamp). As noted below, the n accordance with some embodiments, the shade 114 is made of solar cell material.

The base 110 is shown in accordance with one example of the invention. The base 110 defines an opening for receiving the unit 112.

Figure 2:
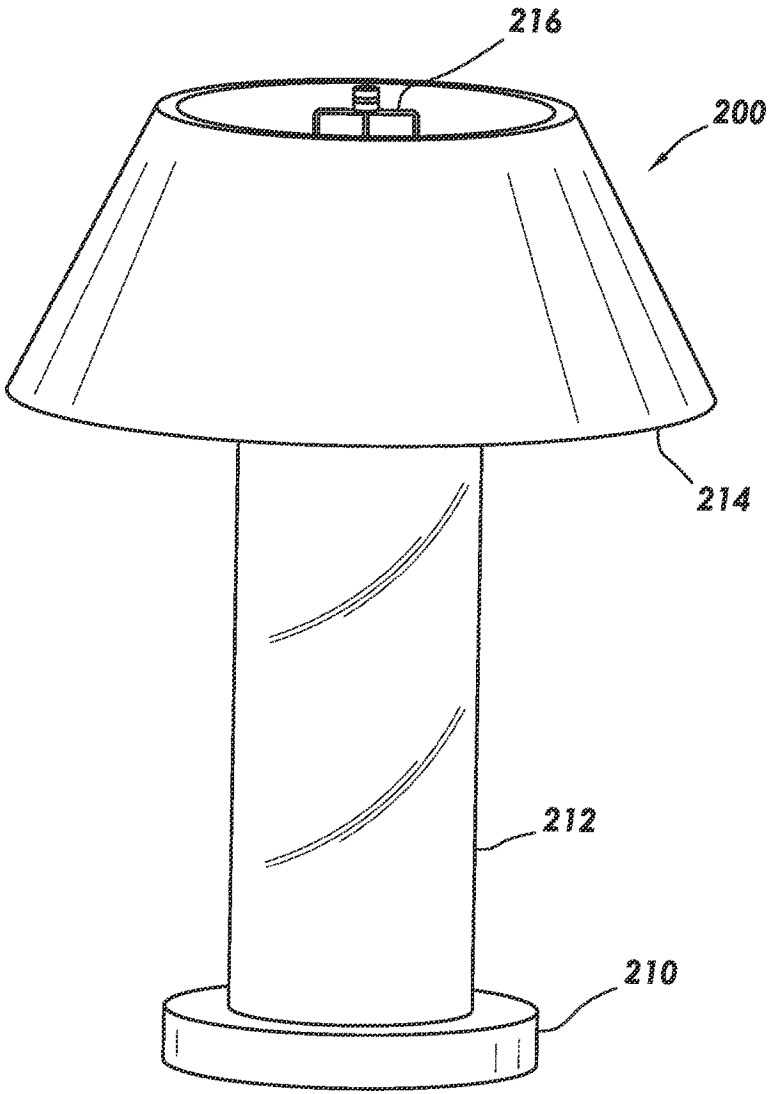
FIG. 2 shows a lamp with a receiving unit and a base in accordance with the various aspects and embodiments of the invention.

Referring now to FIG. 2, a lamp 200 is shown in accordance with one embodiment of the invention. The lamp 200 includes a base 210, a unit 212, a shade 214 and a shade support 216. In accordance with some embodiments, the shade 214 includes solar cells for powering a light bulb connected to the lamp. The lamp 200 includes a socket (not shown), into which a light bulb is secured and used to provide lighting. The lamp 200 includes wiring (not shown) connected to the socket and for connecting to a power source in order to power the light bulb. The base 210 is shown in accordance with one example of the invention. The base 210 defines an opening for receiving the unit 212.

Figure 3:
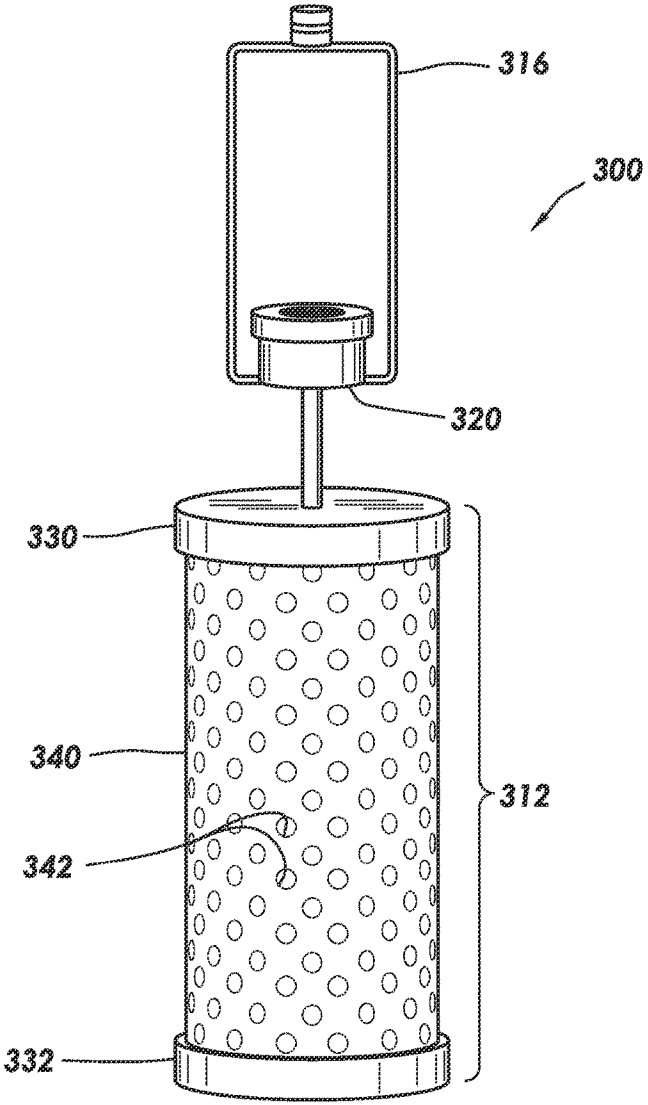
FIG. 3 shows a light bulb receiving section and a receiving unit of a lamp in accordance with the various aspects and embodiments of the invention.

Referring now to FIG. 3, a lamp 300 is shown in accordance with one embodiment of the invention. The lamp 300 includes a unit 312, a shade support 316, and a socket 320. The socket 320 receives a light bulb and has an extension that runs vertically along an axis defined by the shape of the unit 312. The shade support 316 is secured to the socket 320. In one embodiment, the shade support 316 is secured to the unit 312 (not shown). The unit 312 includes an upper cap 330 and a lower cap 332. The upper cap and the lower cap 332 are of the same shape and size. In one example the shape is circular. In another example, the shape is triangular. In another example, the shape is square. As evident from this disclosure, the upper cap 330 and the lower cap 332 can be any shape. As outlined in greater detail below, the shape of the upper cap 330 and the lower cap 332 determine or define the shape of unit 312. In accordance with an embodiment of the invention, the upper cap 330 defines a radial opening or slot from a center hole thereof (not shown). The radial opening allows for removal of the upper cap 330 from the lamp 300 with the socket 320 in place.

The unit 312 includes an outer wall 342 and an inner wall 340. The outer wall 342 is made of translucent or clear material. The inner wall 340 includes multiple holes In accordance with some embodiments and can be made of opaque or translucent material. In accordance with some embodiments, the opacity is sufficient to obscure a portion of a rod running through the unit 312 that supports the socket 320. The upper cap 330 includes an opening for receiving and holding in place the socket 320. In one embodiment, the unit 312 includes a flexible display for displaying images and information.

Figure 4:
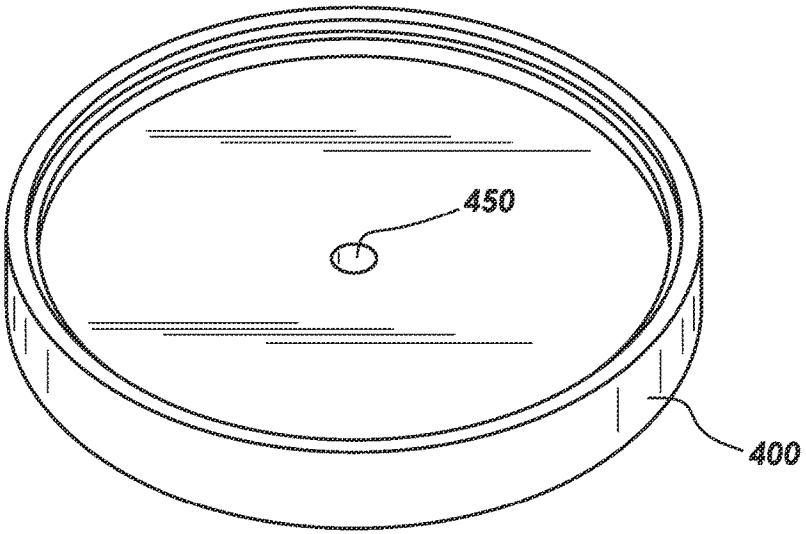
FIG. 4 shows one example of an upper cap for the receiving unit of FIG. 3 in accordance with the various aspects and embodiments of the invention.

Referring now to FIG. 4, an upper cap 400 is shown in accordance with one embodiment of the invention. In accordance with one embodiment of the invention, the upper cap 400 defines a hole 450 for receiving any one of: the socket 320's supporting rod, the shade support 316 of FIG. 3, and/or wires connected to the socket 320 (not shown) In accordance with other examples of the invention, the upper cap includes other openings or other connection points for securing or coupling to the shape support 316. In accordance with one example, the upper cap 400 is received and secured to the outer wall 342 and inner wall 340 in the desired shape.

Figure 5:
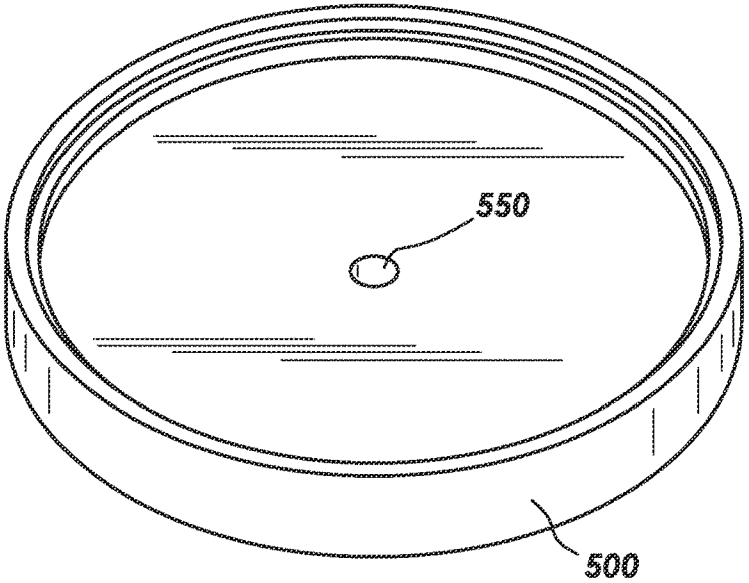
FIG. 5 shows one example of a lower cap for the receiving unit of FIG. 3 in accordance with the various aspects and embodiments of the invention.

Referring now to FIG. 5, a lower cap 500 is shown in accordance with one embodiment of the invention. The lower cap 500 defines a hole 550 (not shown) that allows passing of a wire through, which wire is connected to the socket 320 of FIG. 3 in accordance with one embodiment of the invention. In accordance with other examples of the invention, the lower cap 500 includes other openings or other connection points for securing or coupling the lower cap 500 to the outer wall 342 and the inner wall 340 (FIG. 3). In accordance with one embodiment of the invention, the lower cap 500 includes an outer side with means for coupling or securing the lower cap 332 to the base, such as base 110 of FIG. 1 or base 210 of FIG. 2, respectively. In accordance with the various embodiments of the invention, the means for coupling or securing the lower cap 332 to the base includes tabs that engage the base. In accordance with the various embodiments of the invention, the means for coupling or securing the lower cap 332 to the base includes a threaded portion that threads to the base. In accordance with the various embodiments of the invention, the means for coupling or securing the lower cap 332 to the base includes using a glue or liquid to secure the lower cap 332 to the base.

Figure 6:
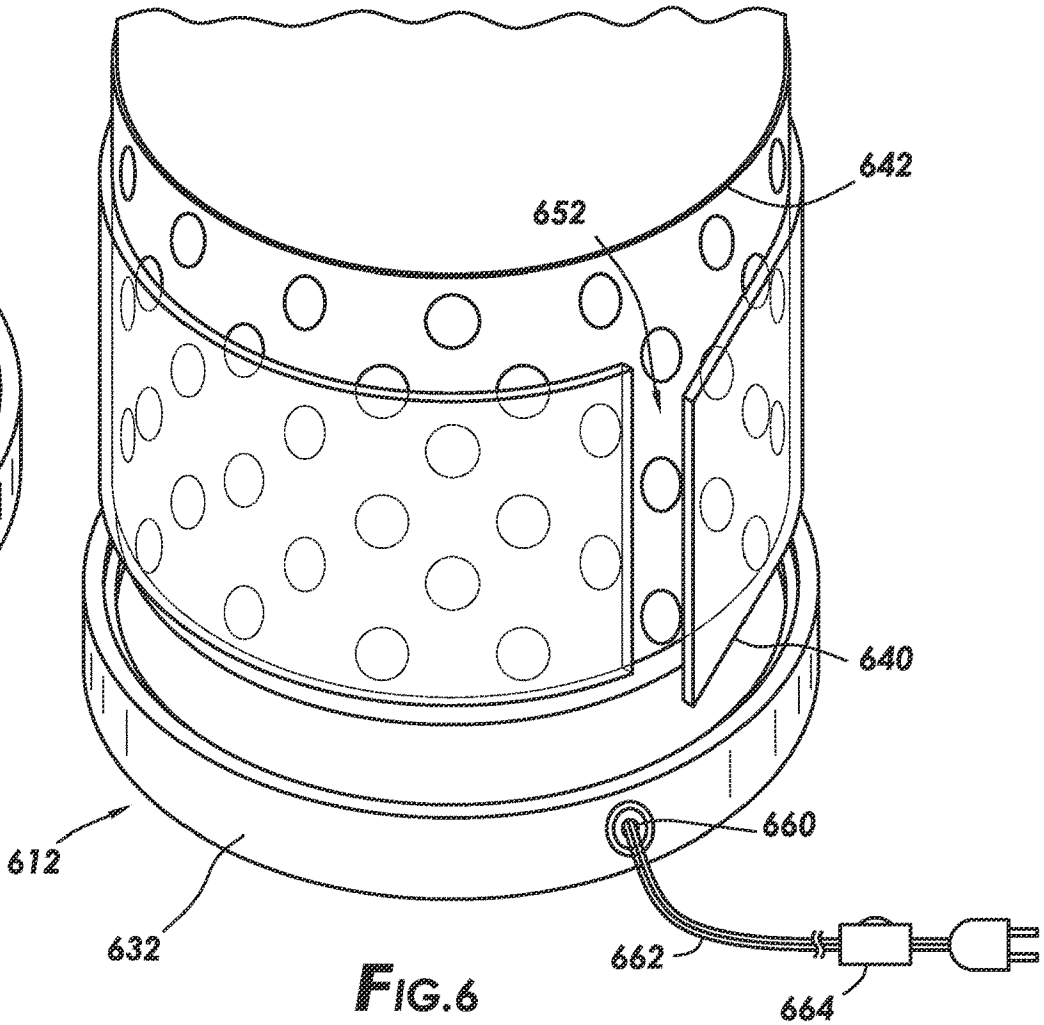
FIG. 6 shows an exploded view of a lamp showing a unit and a base in accordance with the various aspects and embodiments of the invention.

Referring now to FIG. 6, an exploded view of a lamp is shown having a unit 612 in accordance with an embodiment of the invention. The unit 612 includes a lower cap 632, an outer wall 640, and an inner wall 642. In accordance with some embodiments, the inner wall 642 defines openings or holes (as shown). In accordance with some embodiments, the inner wall 642 is solid. In accordance with some embodiments, the inner wall 642 is partially or completely opaque In accordance with some embodiments, the inner wall 642 is transparent or clear. The inner wall 642 and the outer wall 640 are of different diameters or sizes. The outer wall 640 wraps around the inner wall 642. As the outer wall 640 and the inner wall 642 are placed within and secured to the lower cap 632 at one end and the upper cap (not shown in this FIG. 6) at the other end. In accordance with an embodiment of the invention, the outer walls and inner walls are securely held in place by the lower cap 632. In accordance with an embodiment of the invention, the outer walls and inner walls are securely held in place by the lower cap 632 and the upper cab collectively.

When a piece of paper or a decorative paper is placed between the outer wall 640 and the inner wall 642, the paper is held securely in place due to the tension created between the outer wall 640 and the inner wall 642 that results from securing the inner wall 642 and the outer wall 640 inside the lower cap 632 and the upper cap (not shown). In accordance with some embodiments opposing edges of the outer wall 640 define a slit 652. The slit 652 is capable of receiving an insert into the gap formed between the inner wall 642 and the outer wall 640. In accordance with some embodiments, the base 632 defines a hole 660 through which, for example, a power cord 662 passes. In accordance with some embodiments, the hole 660 is aligned with the positioning of the slit 652. In accordance with some embodiments, a switch 664 is disposed along the power cord 662. The switch 664, In accordance with some embodiments, includes a plurality of intensity settings for determining the intensity of illumination for lighting powered via the cord 662. The cord 662 is connect to all light sources of the lamp in accordance with some embodiments. The cord 662 is connect to one of the lighting sources, one of which is shown in FIG. 16A, in accordance with some embodiments of the invention. The cord 662 is connect to all light sources of the lamp and a flat display (as noted below) in accordance with some embodiments.

Figure 7:
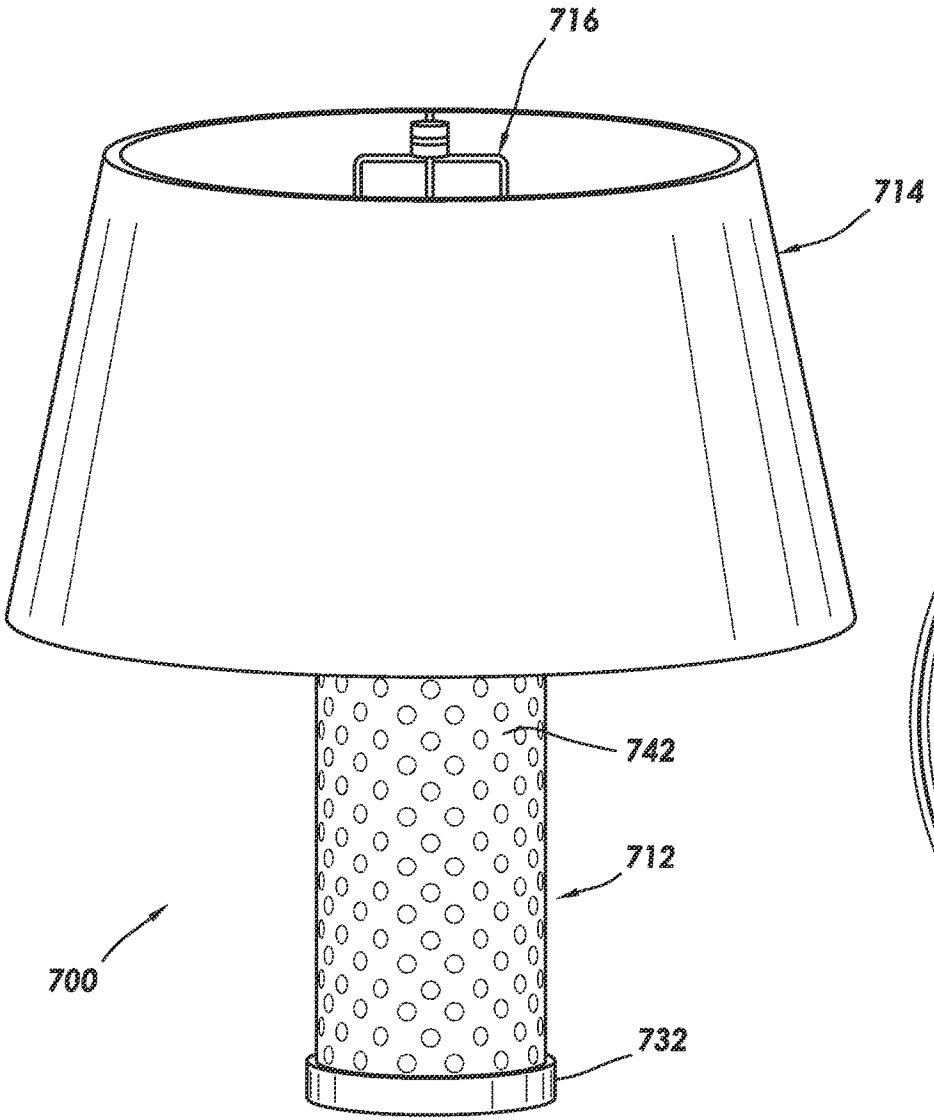
FIG. 7 shows a lamp in accordance with the various aspects and embodiments of the invention.

Referring now to FIG. 7, a lamp 700 is shown in accordance with an embodiment of the invention. The lamp 700 includes a unit 712, shade 714, and a shade support 714. The unit 712 includes an outer wall 742 and a lower cap 732. In accordance with an embodiment of the invention, the lamp 700 includes a decorative paper inserted behind the outer wall 742.

Figure 8:
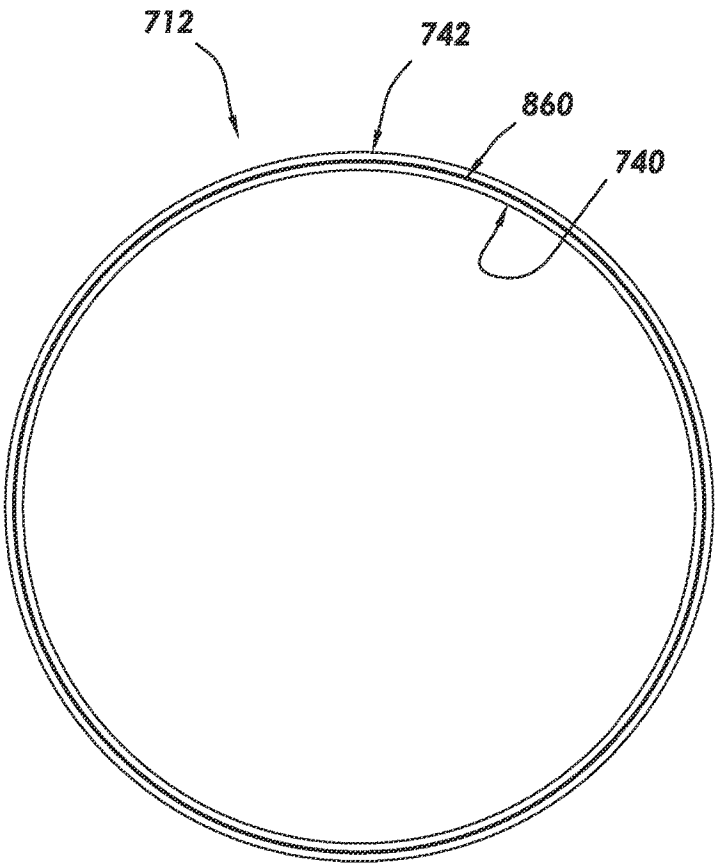
FIG. 8 shows a top cross-sectional view of a receiving unit of FIG. 7 in accordance with the various aspects and embodiments of the invention.

Referring now to FIG. 8, a top cross sectional view of the unit 712 of FIG. 7 is shown in accordance with an embodiment of the invention. The unit 712 includes the outer wall 742 and the inner wall 740. Also the unit 712 is capable of receiving an insert 860 that is positioned and secured between the outer wall 742 and the inner wall 740. As noted herein, the insert 860 may be any paper/thin plastic insert—decorative and/or informational. In accordance with an embodiment of the invention, the insertion 860 is a flexible display that is power by the lamp.

Figure 9:
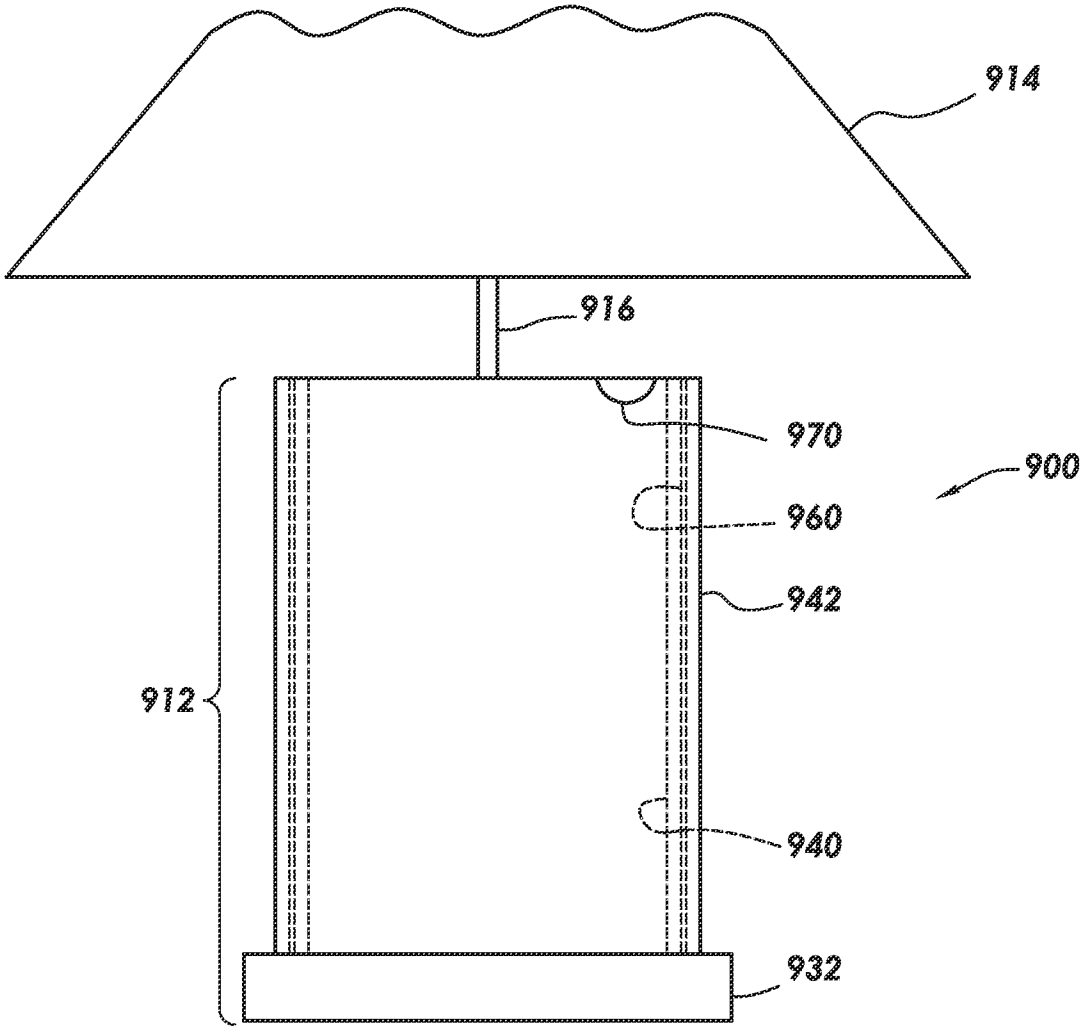
FIG. 9 shows a side view of a lamp that includes one example of a receiving unit in accordance with the various aspects and embodiments of the invention.

Referring now to FIG. 9, a lamp 900 is shown in accordance with an embodiment of the invention. The lamp 900 includes a unit 912, a shade 914, and a shade support 916. The unit 912 includes a lower cap 932, an inner wall 940, an outer wall 942, an insert 960, and a cut-out section 970. The cut-out section 970 allows for use of a thumb to grip the insert 960 for removal and replacement when the unit 912 is kept assembled. In accordance with an embodiment of the invention, the insert 960 is a flexible display that is powered by the lamp 900. In accordance with an embodiment of the invention, the power source for the flexible display is supplied from/through a connection with the socket of the lamp 900, which is connected to a power source using a wired connection. In accordance with an embodiment of the invention, the power source for the flexible display is from solar cells, which includes using the light emitted by the lamp 900 to generate power using the solar cells.

Figure 10:
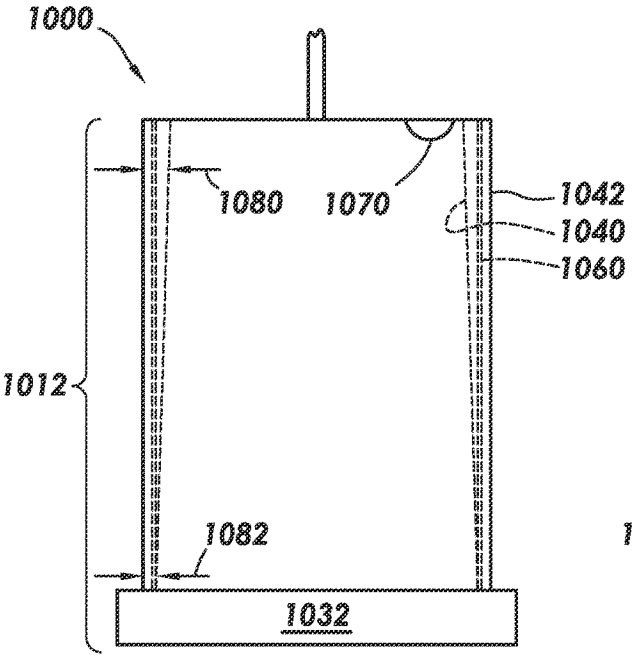
FIG. 10 shows a side view of a lamp that includes one example of a receiving unit in accordance with the various aspects and embodiments of the invention.

Referring now to FIG. 10, a lamp 1000 is shown in accordance with an embodiment of the invention. The lamp 1000 includes a unit 1012. The unit 1012 includes a lower cap 1032, an inner wall 1040, an outer wall 1042, and a cut-out section 1070. The lamp 1000 is shown in accordance with one embodiment with an insert 1060. The cut-out section 1070 allows for use of a thumb to grip the insert 1060 for removal and replacement when the unit 1012 is kept assembled. In accordance with an embodiment of the invention, the inner wall 1040 is angled with respect to the outer wall 1042, such that a top portion 1080 of the unit 1012 is wider than a lower portion 1082 of the unit 1012. This allows for the insert 1060 to be inserted between the inner wall 1040 and the outer wall 1042. The insert 1060 is inserted and, hence, wedged tightly and held in place by the lower portion 1082. In accordance with an embodiment of the invention, the difference in the separation between the portion 1080 and the portion 1082 is caused by having the inner wall 1040 being secured in place at an angle; the thickness of the inner wall 1040 being the same along its entire length. In accordance with an embodiment of the invention, the difference between the separation for the portion 1080 and the portion 1082 is due to a variation in the thickness of the inner wall 1040, such that the inner wall 1040 is thinner near the portion 1080 and thicker near the portion 1082. Thus, the inner wall 1040 is secured in place in a vertical position and the variation in the thickness of the inner wall 1040 (from top to bottom along the length of the inner wall 1040) causes the difference in the gap portion 1080 relative to the gap portion 1082.

Figure 11:
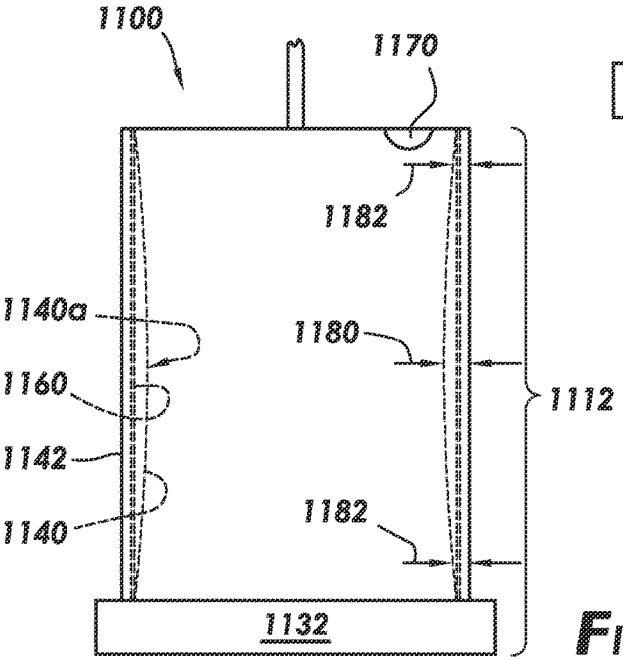
FIG. 11 shows a side view of a lamp that includes one example of a receiving unit in accordance with the various aspects and embodiments of the invention.

Referring now to FIG. 11, a lamp 1100 is shown in accordance with an embodiment of the invention. The lamp 1100 includes a unit 1112. The unit 1112 includes a lower cap 1132, an inner wall 1140, an outer wall 1142, and a cut-out section 1170, wherein the unit 1112 receives and hold in place an insert 1160. The cut-out section 1170 allows for use of a thumb to grip the insert 1160 for removal and replacement when the unit 1112 is kept assembled. Additionally, the cut-out section 1170 allows for an opening to receive a wired connection for powering the insert 1170 in accordance with some embodiments of the invention as related to the various figures. In accordance with an embodiment of the invention, the inner wall 1140 is angled away from the outer wall 1142, such that a center area 1140*a* is concave relative to the outer wall 1142. A top portion 1182 and a bottom portion 1182 of the unit 1112 are narrower than the center area 1140*a* at a center portion 1180 of the unit 1112. This allows for the insert 1160 to be wedged tightly and held in place by top and bottom portions 1182. In accordance with an embodiment of the invention, the difference in the separation between center portion 1180 and top/bottom portions 1182 is caused by having a variation in the thickness (along the length) of the inner wall 1140, such that the inner wall 1140 is thinner near the portion 1180 and thicker near the top/bottom portions 1182. Thus, the inner wall 1140 is secured in place in a vertical position and the variation in the thickness of the inner wall 1140 (from top to center to bottom) causes the difference in the width of the center portion 1180 relative to the bottom/top portions 1182.

Figure 12:
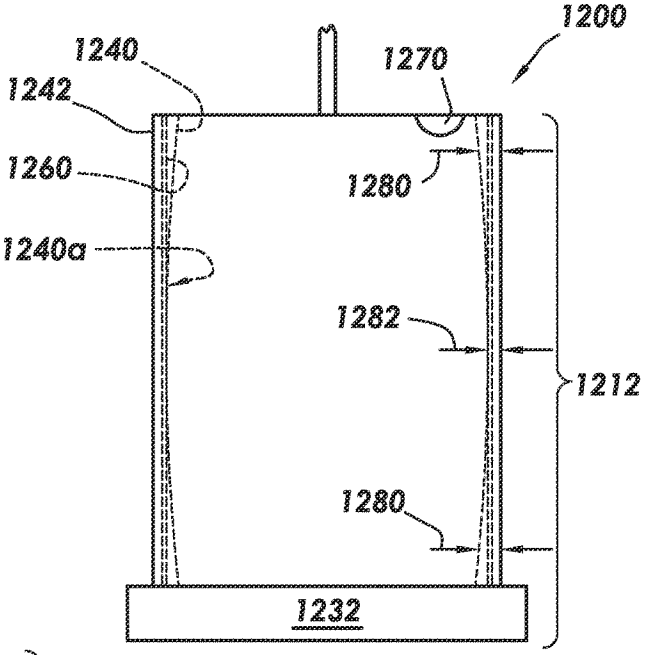
FIG. 12 shows a side view of a lamp that includes one example of a receiving unit in accordance with the various aspects and embodiments of the invention.

Referring now to FIG. 12, a lamp 1200 is shown in accordance with an embodiment of the invention. The lamp 1200 includes a unit 1212 and an insert 1260, as shown. The unit 1212 includes a lower cap 1232, an inner wall 1240, an outer wall 1242, and a cut-out section 1270. The cut-out section 1270 allows for use of a thumb to grip the insert 1260 for removal and replacement when the unit 1212 is kept assembled. In accordance with an embodiment of the invention, the inner wall 1240 is angled toward the outer wall 1242, such that a center area 1240*a* of the inner wall 1240 is convex relative to the outer wall 1242. A middle portion 1282 of the unit 1212 is narrower than the top/bottom portions 1280 with respect to the outer wall 1242. This allows for the insert 1260 to be wedged tightly and held in place at the center area 1240*a* (at the center portion 1282). In accordance with an embodiment of the invention, the difference in the separation between top/bottom portions 1280 and the center portion 1282 is caused by having the inner wall 1240 with a variation in the thickness of the inner wall 1240 along its length. The inner wall 1240 is thinner near the top/bottom portions 1280 resulting in a wider gap; the inner wall 1240 is thicker near the center portion 1282 resulting a narrower gap with respect to the outer wall 1242. Thus, the inner wall 1240 is secured in place in a vertical position and the variation in the thickness of the inner wall 1240 (from top to center to bottom) causes the difference in the thickness of the top/bottom portions 1280 relative to the center portion 1282.

Figure 13:
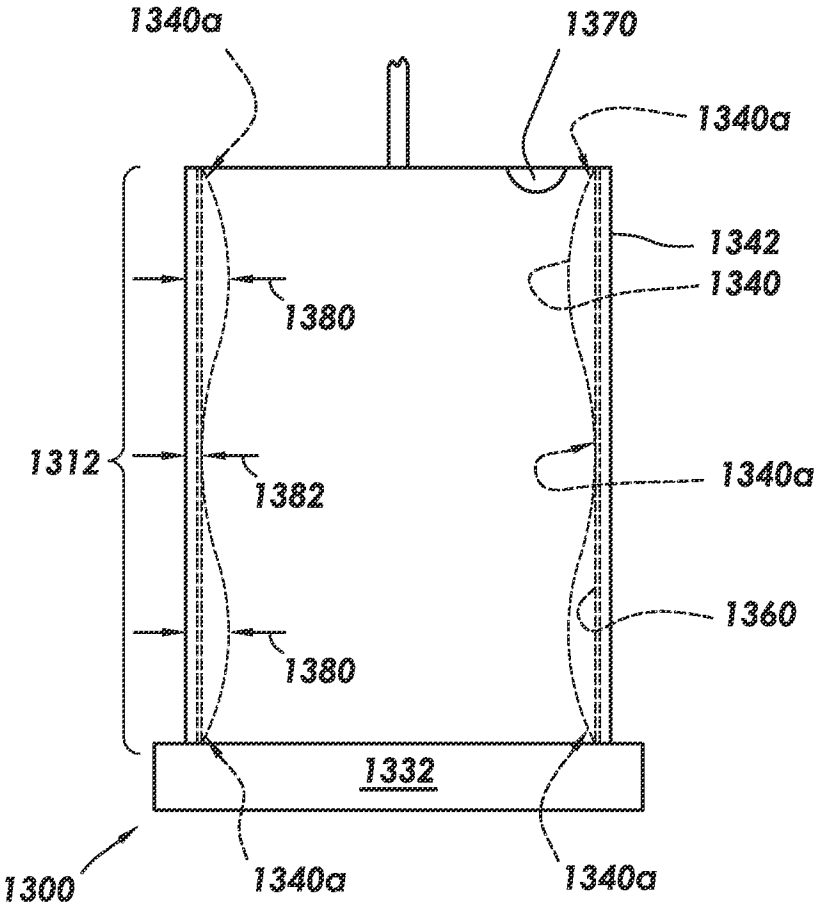
FIG. 13 shows a side view of a lamp that includes one example of a receiving unit in accordance with the various aspects and embodiments of the invention.

Referring now to FIG. 13, a lamp 1300 is shown in accordance with an embodiment of the invention. The lamp 1300 includes a unit 1312. The unit 1312 includes a lower cap 1332, an inner wall 1340, an outer wall 1342, an insert 1360, and a cut-out section 1370. The cut-out section 1370 allows for use of a thumb to grip the insert 1360 for removal and replacement when the unit 1312 is kept assembled. In accordance with an embodiment of the invention, the inner wall 1340 is curved toward the outer wall 1342 at areas 1340*a*. The portions 1380 are concave relative to the outer wall 1342. A middle portion 1382 is narrower at the area 1340*a* similar to the top/bottom portions at areas 1340*a*. This allows for the insert 1360 to be wedged tightly and held in place using the areas 1340*a*, including at the center portion 1382. In accordance with an embodiment of the invention, the difference in the separation between top/bottom/center portions 1382 in areas 1340*a* and the portions 1380 is caused by having a variation in the thickness of the inner wall 1340. The inner wall 1340 is thinner near the portions 1380 and thicker near the top/bottom/center areas 1340*a*. Thus, the inner wall 1340 is secured in place in a vertical position and the variation in the thickness of the inner wall 1340 (from top to center to bottom) causes the difference in the thickness of the top/bottom/center areas 1340*a* relative to the portions 1380.

Figure 14:
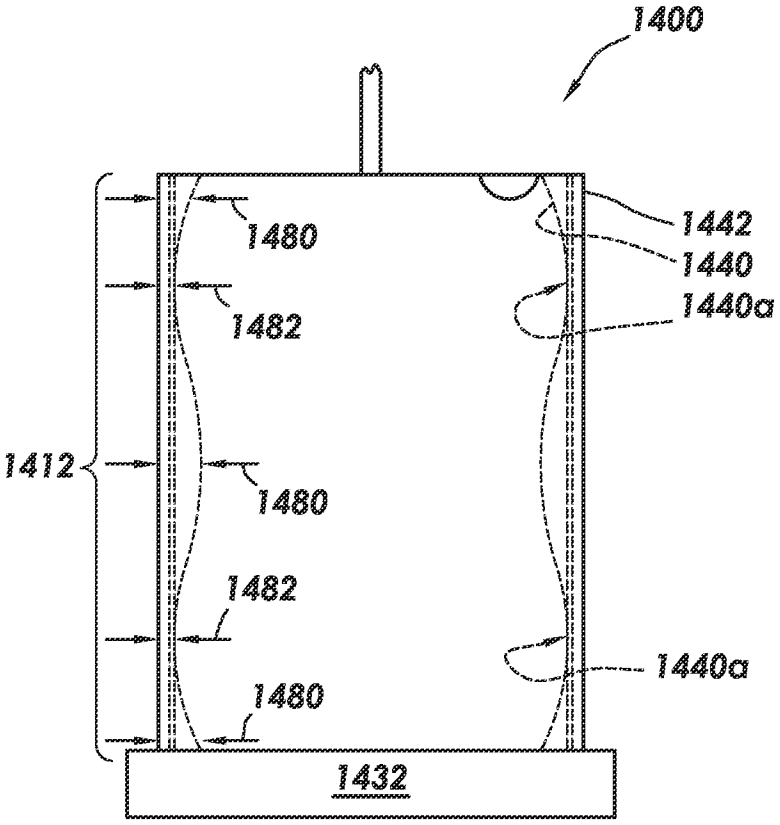
FIG. 14 shows a side view of a lamp that includes one example of a receiving unit in accordance with the various aspects and embodiments of the invention.

Referring now to FIG. 14, a lamp 1400 is shown in accordance with an embodiment of the invention. The lamp 1400 includes a unit 1412. The unit 1412 includes a lower cap 1432, an inner wall 1440, an outer wall 1442, an insert 1460, and a cut-out section 1470. The cut-out section 1470 allows for use of a thumb to grip the insert 1460 for removal and replacement when the unit 1412 is kept assembled. In accordance with an embodiment of the invention, the inner wall 1440 is curved toward the outer wall 1442 at areas 1440*a*. The portions 1480 are concave relative to the outer wall 1442. The portions 1482 are convex relative to the outer wall 1442. Portions 1482 are narrower than portion 1480. This allows for the insert 1460 to be wedged tightly and held in place using the areas 1440*a*, which is at the portions 1482. In accordance with an embodiment of the invention, the difference in the separation between portions 1482 and the portions 1480 is caused by having a variation in the thickness of the inner wall 1440. The inner wall 1440 is thinner near the portions 1480 and thicker near the portions 1482. Thus, the inner wall 1440 is secured in place in a vertical position and the variation in the thickness of the inner wall 1440 (from top to center to bottom) causes the difference in the thickness of the portions 1482 relative to the portions 1480.

Figure 15B:
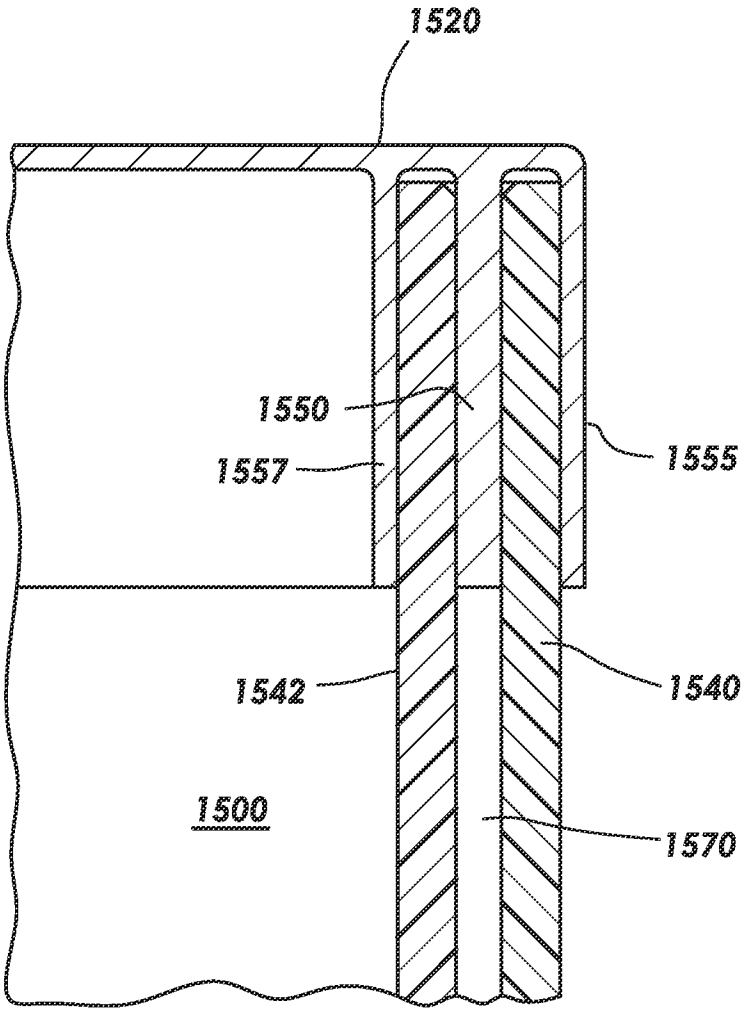
FIG. 15B shows a cross-sectional view of a portion of a lamp, including one example of an upper cap receiving an inner wall and an outer wall in accordance with the various aspects and embodiments of the invention.
Figure 15A:
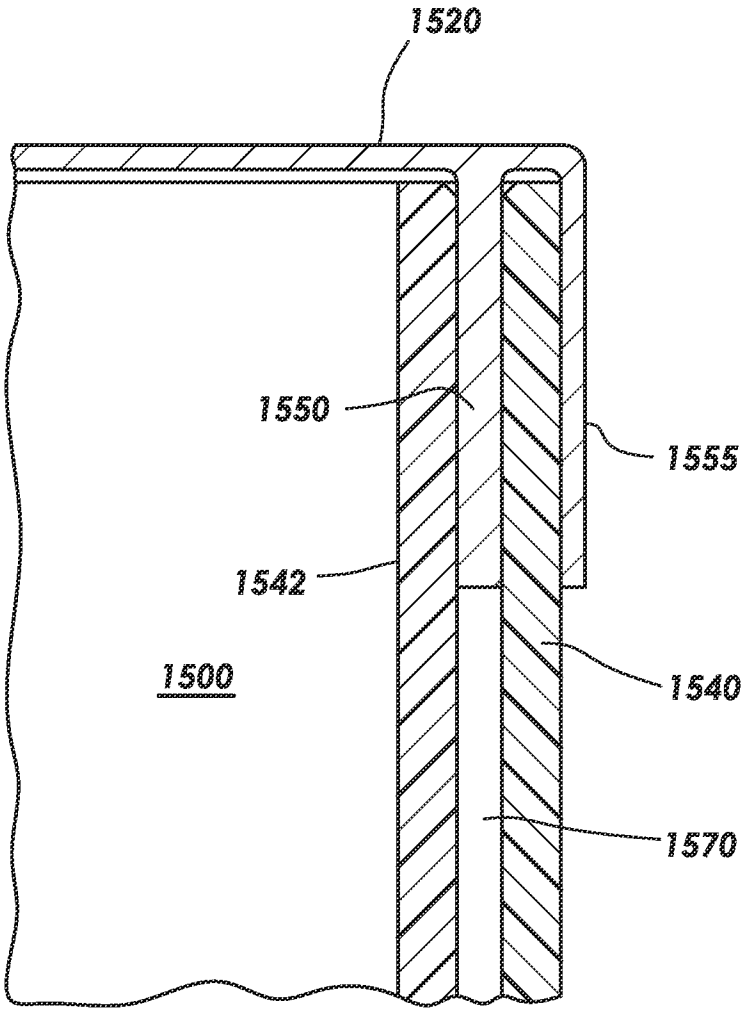
FIG. 15A shows a cross-sectional view of a portion of a lamp, including one example of an upper cap receiving an inner wall and an outer wall in accordance with the various aspects and embodiments of the invention.

Referring to FIG. 15A, a cross-section of a portion of a lamp 1500 is shown in accordance with some embodiments of the invention. The lamp 1500 includes an upper cap 1520, an outer wall 1540, and an inner wall 1542. Portions 1550 and 1555 protrude from the upper cap 1520 to thereby stabilize the outer wall 1540 and the inner wall 1542 and maintain the gap 1570, into which the insert is placed through, a slit as discussed below.

Referring to FIG. 15B, a cross-section of a portion of a lamp 1500 is shown in accordance with some embodiments of the invention. The lamp 1500 includes an upper cap 1520, an outer wall 1540, and an inner wall 1542. Portions 1550, 1555, and 1557 protrude from the upper cap 1520 to thereby stabilize the outer wall 1540 and the inner wall 1542 and maintain the gap 1570, into which the insert is placed through, a slit as discussed below.

In accordance with some embodiments, the outer wall 1540 and the inner wall 1542 are made by forming and bending a rectangular-like shape into a cylindrical shape through inserting into the upper cap 1520 and lower cap (not shown). The rectangular-like shape includes a cut-out portion that defines a slit when the rectangular-like shape is formed into a cylindrical shape.

In accordance with some embodiments, the outer wall 1540 and inner wall 1542 are manufactured as a cylinder of appropriate dimensions. The formed cylinder for the outer wall 1540 and the inner wall 1542 are seamless and the outer wall 1540 includes a slit (discussed below) defined therein by cutting out or removing a portion of the cylinder's wall.

Referring to FIG. 16A, a cross-sectional view of a lamp 1600 is shown. The lamp includes a unit 1612. In accordance with some embodiments, a socket 1620 is disposed within the unit 1612, held in place by a support 1630. The socket 1620 includes a cord that supplies power to the socket 1620. As with other embodiments, the lamp 1600 includes a lower cap 1632, an outer wall 1640, and an inner wall 1642. The cap 1632 defines a hole 1635 through with the cord passes. In accordance with some embodiments, the outer wall 1640 includes a slit that matches the distance between the upper cap (not shown) and the lower cap 1632 and the slit is positioned in-line with and above the opening 1635.

Figure 16B:
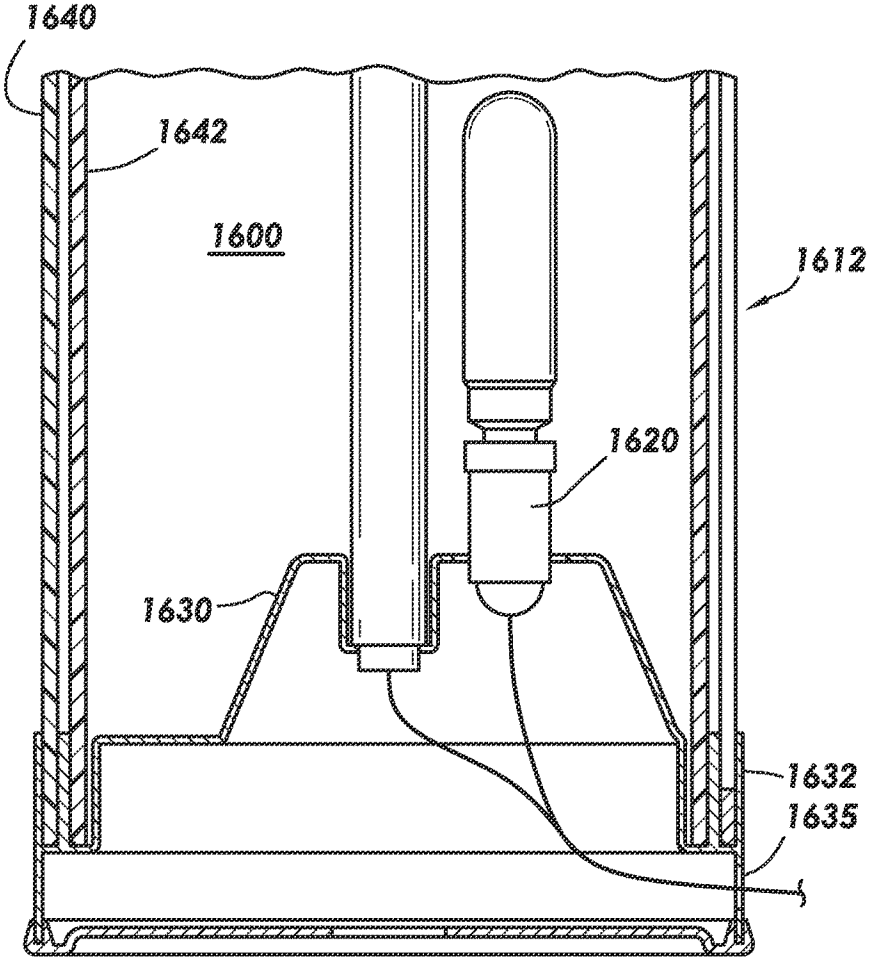
FIG. 16B shows a cross-sectional view of a portion of a lamp having a socket disposed in a cavity defined by an inner wall in accordance with the various aspects and embodiments of the invention.
Figure 16A:
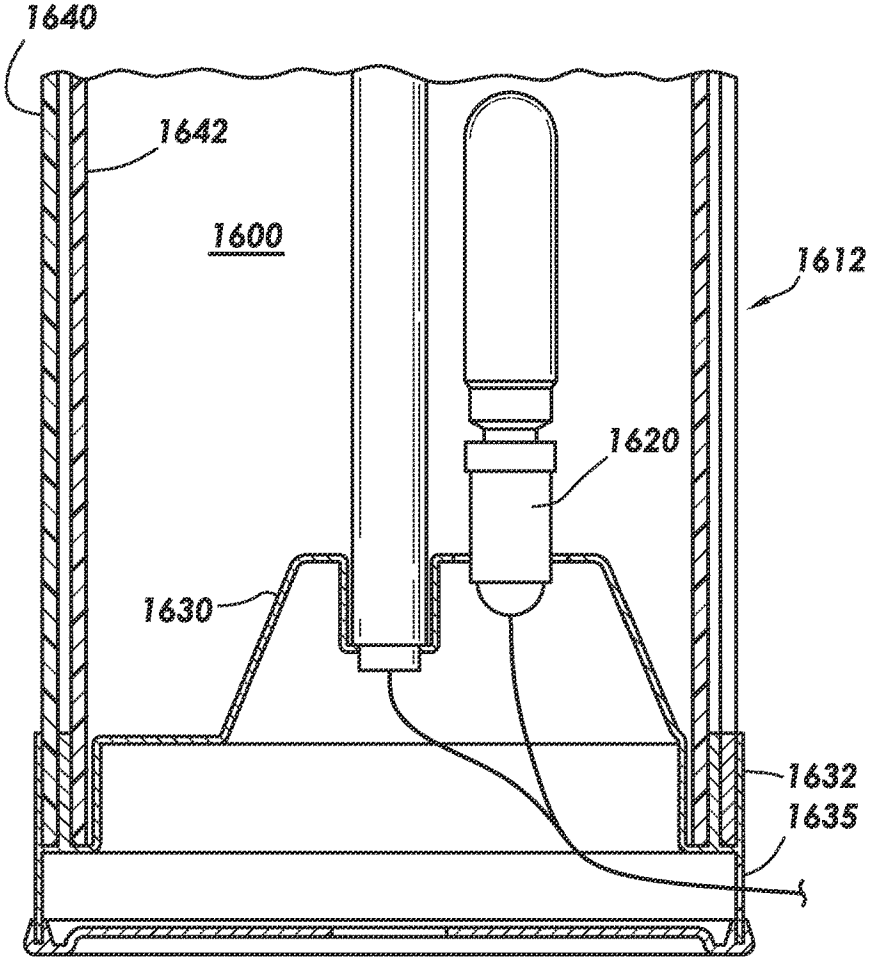
FIG. 16A shows a cross-sectional view of a portion of a lamp having a socket disposed in a cavity defined by an inner wall in accordance with the various aspects and embodiments of the invention.

Referring to FIG. 16B, a cross-sectional view of a lamp 1600 is shown. The lamp includes a unit 1612. In accordance with some embodiments, a socket 1620 is disposed within the unit 1612, held in place by a support 1630. The socket 1620 includes a cord that supplies power to the socket 1620. As with other embodiments, the lamp 1600 includes a lower cap 1632, an outer wall 1640, and an inner wall 1642. The cap 1632 defines a hole 1635 through with the cord passes. In accordance with some embodiments, the outer wall 1640 includes a slit that is longer than the distance between the upper cap (not shown) and the lower cap 1632 and the slit is positioned in-line with and above the opening 1635.

Figure 17:
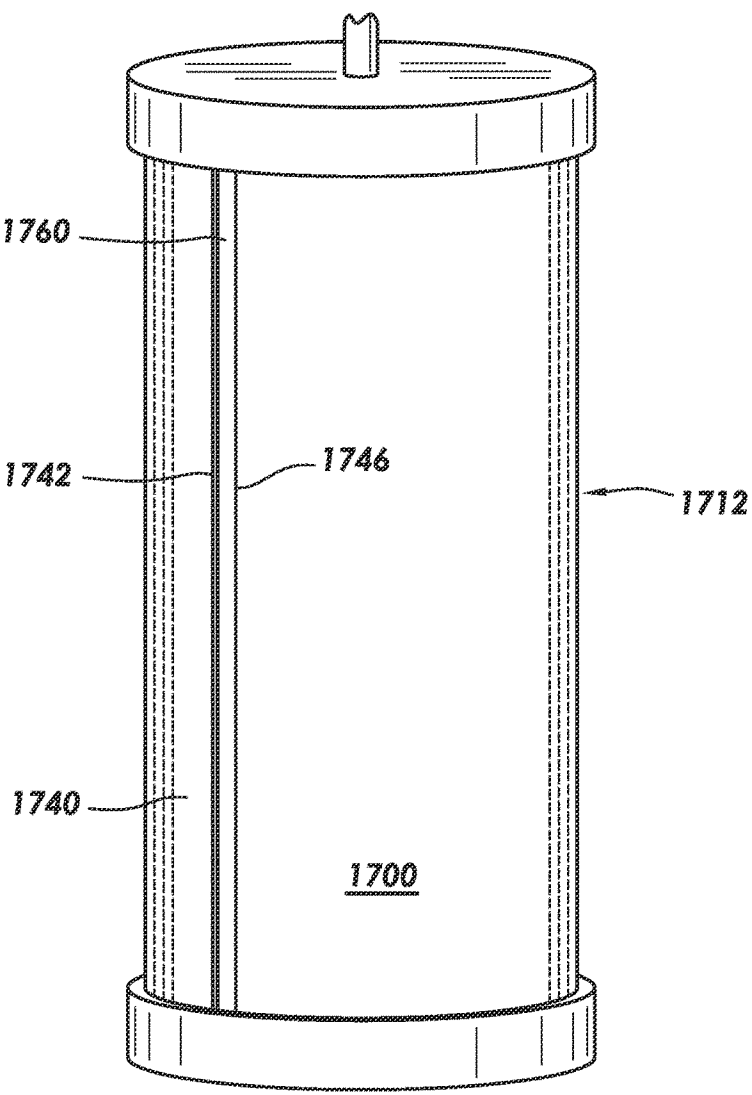
FIG. 17 shows a side view of a portion of a lamp having a slit in accordance with the various aspects and embodiments of the invention.

Referring to FIG. 17, a portion of a lamp 1700 is shown. The lamp 1700 includes a unit 1712 having an outer wall 1740. In accordance with some embodiments, opposing vertical edges 1742, 1746 of the outer wall 1740 define a slit 1760. In accordance with various embodiments as outline above, the slit 1760 can be created or defined in various ways. As will be described with reference to FIG. 18, in accordance with some embodiments, the slit 1760 provides for receiving an insert into a gap between the outer wall 1740 and an inner wall.

Figure 18:
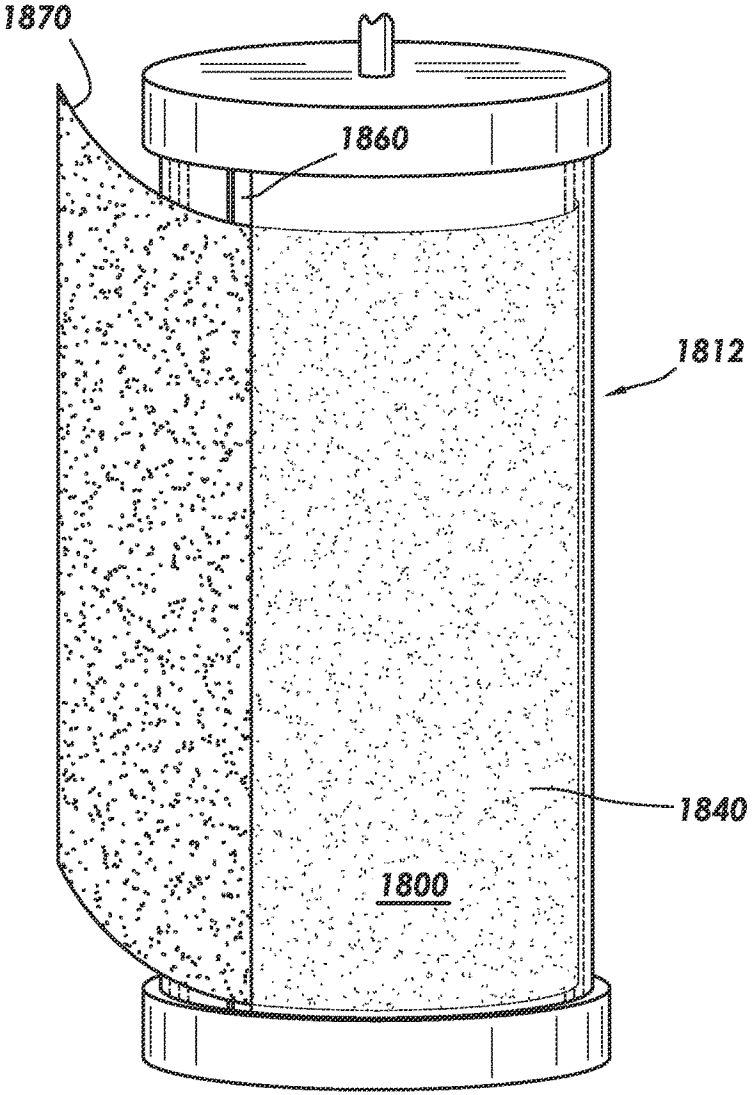
FIG. 18 shows a side view of a lamp receiving an insert through a slit in accordance with the various aspects and embodiments of the invention.

Referring to FIG. 18, a portion of a lamp 1800, which may be the lamp 1700, is shown in accordance with the various embodiments of the invention. The lamp 1800 includes a unit 1812 having an outer wall 1840 defining a slit 1860. FIG. 18 depicts an insert 1870 being received into the slit 1860.

Figure 19:
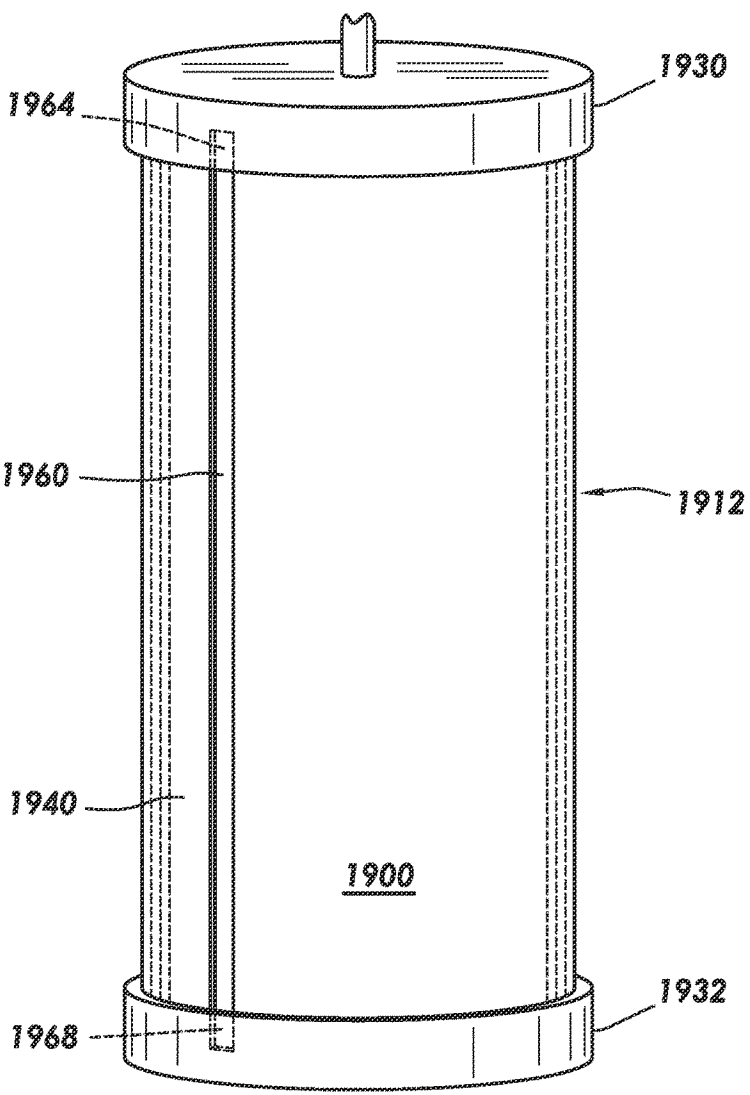
FIG. 19 shows a side view of a portion of a lamp having a slit in accordance with the various aspects and embodiments of the invention.

Referring to FIG. 19, a portion of a lamp 1900 is shown. The lamp 1900 includes a unit 1912 having an upper cap 1930, a lower cap 1932, and an outer wall 1940. In accordance with some embodiments, the outer wall 1940 includes a slit 1960, which may be a cutout. Opposing ends 1964 and 1968 of the cutout forming the slit 1960 are covered by the upper cap 1930 and the lower cap 1932, respectively. As will be described with reference to FIG. 20, in accordance with some embodiments, the slit 1960 provides for receiving an insert into a gap between the outer wall 1940 and an inner wall.

Figure 20:
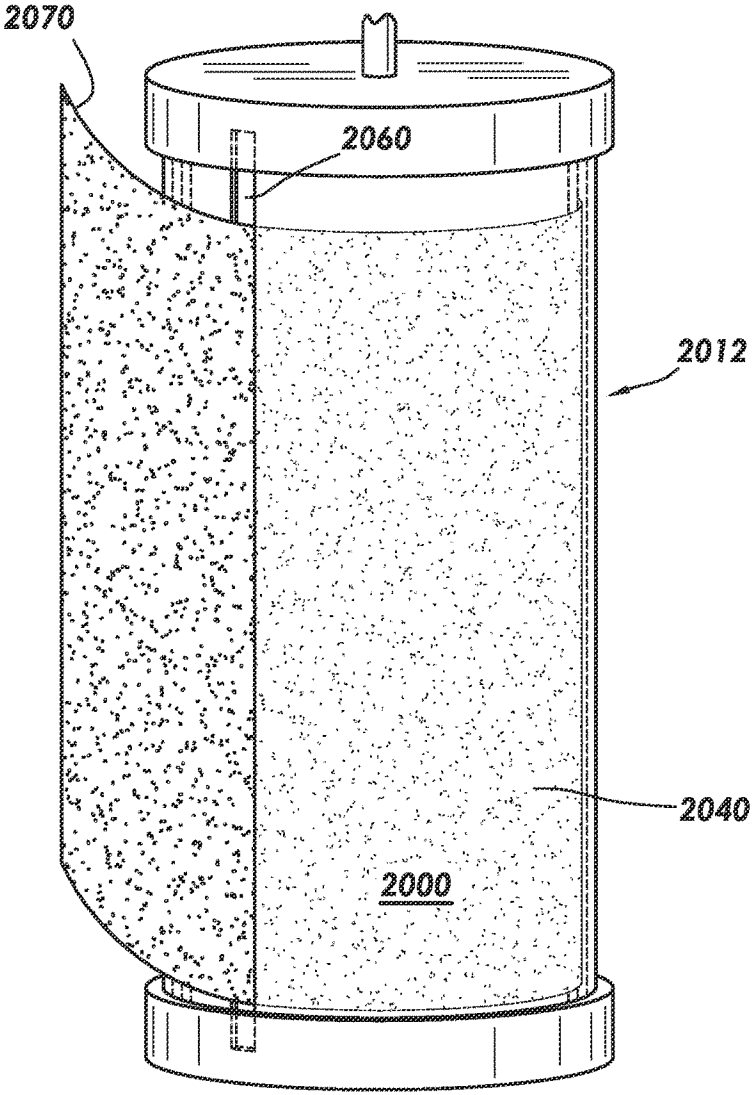
FIG. 20 shows a side view of a lamp receiving an insert through a slit in accordance with the various aspects and embodiments of the invention.

Referring to FIG. 20, a portion of a lamp 2000, which may be the lamp 1900, is shown. The lamp 2000 includes a unit 2012 having an outer wall 2040 defining a slit 2060. FIG. 20 depicts an insert 2070 being received into the slit 2060. As noted in accordance with the various embodiments of the invention, the lit 2060 can be defined in a number of different ways.

Unless defined otherwise, all technical and scientific terms used herein have the same meaning as commonly understood by one of ordinary skill in the art to which this invention belongs. The verb "couple," its gerundial forms, and other variants, should be understood to refer to either direct connections or operative manners of interaction between elements of the invention through one or more intermediating elements, whether or not any such intermediating element is recited. Any methods and materials similar or equivalent to those described herein can also be used in the practice of the invention. Representative illustrative methods and materials are also described.

All publications and patents cited in this specification are herein incorporated by reference as if each individual publication or patent were specifically and individually indicated to be incorporated by reference and are incorporated herein by reference to disclose and describe the methods and/or system in connection with which the publications are cited. The citation of any publication is for its disclosure prior to the filing date and should not be construed as an admission that the invention is not entitled to antedate such publication by virtue of prior invention. Further, the dates of publication provided may be different from the actual publication dates which may need to be independently confirmed.

Additionally, it is intended that such equivalents include both currently known equivalents and equivalents developed in the future, i.e., any elements developed that perform the same function, regardless of structure. The scope of the invention, therefore, is not intended to be limited to the exemplary embodiments shown and described herein.

An article of manufacture (e.g., lamps or electrical devices) may include a non-transitory computer readable medium or storage that may include a series of instructions, such as computer readable program steps or code encoded therein. In certain aspects of the invention, the non-transitory computer readable medium includes one or more data repositories. Thus, in certain embodiments that are in accordance with any aspect of the invention, computer readable program code (or code) is encoded in a non-transitory computer readable medium of the computing device. The processor or a module, in turn, executes the computer readable program code to create or amend an existing computer-aided design using a tool. The term "module" as used herein may refer to one or more circuits, components, registers, processors, software subroutines, or any combination thereof. In other aspects of the embodiments, the creation or amendment of the computer-aided design is implemented as a web-based software application in which portions of the data related to the computer-aided design or the tool or the computer readable program code are received or transmitted to a computing device of a host.

An article of manufacture or system, in accordance with various aspects of the invention, is implemented in a variety of ways: with one or more distinct processors or microprocessors, volatile and/or non-volatile memory and peripherals or peripheral controllers; with an integrated microcontroller, which has a processor, local volatile and non-volatile memory, peripherals and input/output pins; discrete logic which implements a fixed version of the article of manufacture or system; and programmable logic which implements a version of the article of manufacture or system which can be reprogrammed either through a local or remote interface. Such logic could implement a control system either in logic or via a set of commands executed by a processor.

Accordingly, the preceding merely illustrates the various aspects and principles as incorporated in various embodiments of the invention. It will be appreciated that those of ordinary skill in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Therefore, the scope of the invention, therefore, is not intended to be limited to the various aspects and embodiments discussed and described herein. Rather, the scope and spirit of invention is embodied by the appended claims.

What is claimed is:

1. A lamp comprising:

a base; and a unit secured to the base, the unit is capable of receiving an insert and includes:

a lower cap defining an opening;

an upper cap defining an opening;

an inner wall; and an outer wall;

wherein the outer wall is positioned about the inner wall to define a gap therebetween, wherein the outer wall about the inner wall are secured to the lower cap at one end and to the upper cap at the other end thereby defining the gap, and wherein the outer wall is cylindrical in shape and cut to define a slit for receiving the insert into the gap.

2. The lamp of claim 1 further comprising a socket for receiving a light bulb, wherein the socket extends through the defined opening in the upper cap and the socket is secured to the unit.

3. The lamp of claim 1 wherein the inner wall varies in thickness along its length.

4. The lamp of claim 1, wherein the insert is a decorative print.

5. The lamp of claim 1, wherein the insert is printed text.

6. The lamp of claim 5, wherein the printed text is advertisement.

7. The lamp of claim 5, wherein the printed text is a menu.

8. The lamp of claim 1, wherein the insert is a flexible display that is powered by solar cells.

9. The lamp of claim 1, wherein the insert is a flexible display using the socket as a power source.

10. The lamp of claim 1 further comprising a power cord protruding through the defined hole in the lower cap, wherein the hole generally aligns with the slit.

11. The lamp of claim 10, wherein the cord includes a switch having a plurality of intensity settings.

12. The lamp of claim 1 wherein the inner wall varies in thickness.

13. A lamp comprising:

a base; and a unit secured to the base, the unit is capable of receiving an insert and includes:

a lower cap defining an opening;

an upper cap defining an opening;

an inner wall; and an outer wall;

wherein the outer wall is positioned about the inner wall to define a gap therebetween, wherein the outer wall about the inner wall are secured to the lower cap at one end and to the upper cap at the other end thereby defining the gap, wherein the outer wall defines a slit for receiving the insert into the gap, and wherein the outer wall is formed into a cylindrical shape by bending a rectangular piece such that opposing edges of the rectangular piece are brought into contact to define the slit.

14. A lamp comprising:

a base; and a unit secured to the base, the unit is capable of receiving an insert and includes:

a lower cap defining an opening;

an upper cap defining an opening;

an inner wall; and an outer wall;

wherein the outer wall is positioned about the inner wall to define a gap therebetween, wherein the outer wall about the inner wall are secured to the lower cap at one end and to the upper cap at the other end thereby defining the gap, and wherein the outer wall is cut to define a slit for receiving the insert into the gap.

15. The lamp of claim 14, wherein the insert is printed text.

16. The lamp of claim 14, wherein the insert is an image.

17. The lamp of claim 14, wherein the insert is a flexible display that is powered by solar cells.

18. The lamp of claim 14, wherein the insert is a flexible display using the socket as a power source.

19. The lamp of claim 14 further comprising a power cord protruding through the defined hole in the lower cap, wherein the hole generally aligns with the slit.

20. The lamp of claim 14, wherein the inner wall varies in thickness.

* * * * *